United States Patent [19]

Höhlein et al.

[11] Patent Number: 4,643,311

[45] Date of Patent: Feb. 17, 1987

[54] STACKABLE LONG-TERM STORAGE CONTAINER, PREFERABLY FOR RADIOACTIVE WASTE

[75] Inventors: Günter Höhlein, Helmsheim; Wilhelm Hempelmann, Eggenstein-Leopoldshafen; Günter Waldenmeier; Rainer Köster, both of Karlsruhe; Fritz Meyer, Sulingen; Ulrich Pfeifer, Attendorn, all of Fed. Rep. of Germany

[73] Assignee: Kernforschungszentrum Karlsruhe GmbH, Karlsruhe, Fed. Rep. of Germany

[21] Appl. No.: 713,314

[22] Filed: Mar. 18, 1985

[30] Foreign Application Priority Data

Jul. 14, 1984 [DE] Fed. Rep. of Germany ..... 3425978

[51] Int. Cl.[4] ..... B65D 21/04; B65D 8/18; G21F 5/00

[52] U.S. Cl. ..... 206/508; 206/509; 220/66; 220/85 K; 220/DIG. 6; 250/506.1; 250/507.1

[58] Field of Search ..... 206/508, 509; 220/66, 220/67, 85 K, DIG. 6; 250/506.1, 507.1

[56] References Cited

U.S. PATENT DOCUMENTS

| | | | |
|---|---|---|---|
| 221,927 | 11/1879 | Mason | 220/85 K |
| 1,441,674 | 1/1923 | Foster | 220/DIG. 6 |
| 2,049,977 | 8/1936 | Ross | 220/DIG. 6 |
| 4,016,096 | 4/1977 | Meyer | 250/507.1 |
| 4,447,729 | 5/1984 | Doroszlai | 250/506.1 |

FOREIGN PATENT DOCUMENTS

| | | | |
|---|---|---|---|
| 1111564 | 7/1961 | Fed. Rep. of Germany | 206/509 |
| 1231159 | 12/1966 | Fed. Rep. of Germany | 206/508 |
| 1232681 | 10/1960 | France | 206/509 |
| 892961 | 4/1962 | United Kingdom | 206/509 |

*Primary Examiner*—George E. Lowrance

[57] ABSTRACT

Stackable long-term storage container especially for radioactive waste comprises especially convoluted lid and bottom pieces to facilitate stacking. The lid is convoluted providing an annular projection which serves to allow grabbing of the lid and, together therewith, the drum. The floor has a rim which extends axially away from the floor and then is bent over upward toward the drum with drainage openings provided at the bottom edge. A resilient jacket is disposed around the bottom edge and surrounds the rim to prevent direct contact between the drums and scratching during stacking. A fiberglass reinforced plastic insert inside the drum protects the inner wall from damage. The special shape of the drum prevents causes for corrosion under all operating conditions of the drum, especially during very rough handling of the drum during filling, transport and storage.

2 Claims, 1 Drawing Figure

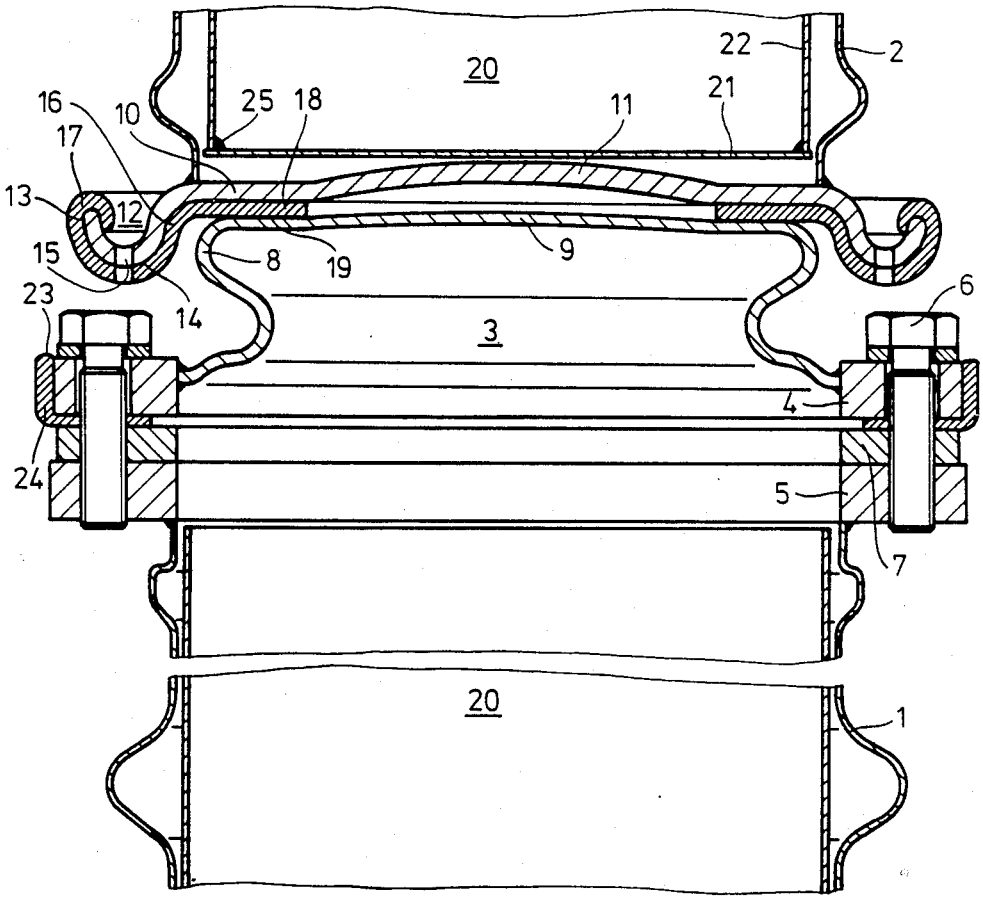
20
22
2
21
25
18
11
16
10
17
13
12
15
8
19
9
23
14
6
3
4
24
5
7
20
1

STACKABLE LONG-TERM STORAGE CONTAINER, PREFERABLY FOR RADIOACTIVE WASTE

BACKGROUND OF THE INVENTION

The invention relates to a stackable long-term storage container.

During the long-term storage of stackable drums containing, for example, radioactive waste, a series of problems arises which results in certain limits for the suitability of many types of drums for these purposes. In addition, these drums are subject to extreme demands regarding their corrosion resistance necessary for very long times, that is, they must be provided with a very high-quality coating. Furthermore, the drums are generally subject to very rough treatment during filling and handling so that the high-quality surface always is in danger of being damaged. The requirements of simultaneous high-quality corrosion protection and impact and shock resistance are actually in opposition to one another.

The object of the invention is to provide a stackable storage drum for hazardous substances, especially for radioactive waste, having a good long-term resistance, with the following properties:

1. Best possible inner and outer corrosion protection;
2. Maintenance of this corrosion protection under all operating conditions, especially during very rough handling of the drum during the process of filling, transporting and storing;
3. No damage to the corrosion protection even after accidental dropping of the drum onto its bottom rim.

SUMMARY OF THE INVENTION

In a stackable long-term storage container for hazardous substances, the lid projects outwardly and the bottom projects inwardly with the lid convolution fitting inside the floor convolution and having an outwardly projecting area providing an annular recess for grabbing the container. The bottom rim and the outer edge of the drum opening flange have a diameter greater than that of the main portion of the drum so as to form edges for rolling the drum. The bottom rim projects axially away from the floor and is then bent over upwardly toward the drum. It is surrounded by a resilient jacket which covers the rolling edge and which has a section extending toward the center of the floor, thereby covering the contact area between two drums stacked on top of one another. The floor edges have drainage openings which also extend through the resilient jacket to prevent collection of liquid. The floor is bulged inwardly at its center and the lid is bulged outwardly at its center. The interior of the drum is lined with a fiberglass reinforced plastic insert, whose bottom rests on the drum floor and whose wall abuts the drum wall, the corner area between the insert floor and insert wall being cast out.

A drum constructed in such an advantageous manner is especially well suited for temporary or final storage of nuclear waste. The long-term durability is due above all to the best possible preservation of the anti-corrosion coating under difficult, that is, very rough, operating conditions through the special form of the drum and seal structure and the protective insert, and through the shape of the bottom rim which largely prevents corrosion due to liquid remaining on the drum. Liquids coming in contact with the drum can run off very easily, that is, rain water cannot collect anywhere and thereby cause corrosion. The bottom rim with the formed seal structure may also serve as impact protection if the drum drops onto the bottom rim, such that the paint coating remains undamaged.

SHORT DESCRIPTION OF THE DRAWING

The details of the storage drum are shown schematically in the single FIGURE, wherein two identical drums 1 and 2 are shown stacked on top of one another for longterm storage.

DESCRIPTION OF A PREFERRED EMBODIMENT

As shown in the FIGURE, the lower drum 1 is closed with a lid 3, the lid flange 4 being bolted to the drum opening flange 5 by means of the bolts 6. A seal 7 is disposed between the flanges 4 and 5. The wall of the drums 1, 2 is welded to the drum opening flange 5 and the drum lid 3 is welded to the upper edge of the lid flange 4. A shock protective jacket 24 of L-shaped cross-section is disposed around the outer edge 23 of the lid flange 4; it is either cemented or clamped between the flanges 4 and 5 together with the seal 7. Alternatively, the ring 24 may be dished so as to extend over the drum flange 5.

The lid 3 extends upwardly and has a neck, and above the neck a smoothly bent rim 8 projecting radially outwardly so as to allow grabbing of the lid 3 and together therewith the entire drum 1. The rim 8 simultaneously forms a kind of deformation zone for the protection of the drum when dropping onto the edge of the lid. The shape of the lid 3 is slightly convex (bulged) at the upper surface. The bulge 9 of the lid, which is integrally formed and continuously extends from the rim 8, prevents the collection on the lid 3 of liquid, which would present a particular source of corrosion over the long storage time.

The drum floor 10 is welded to the drum wall 22 at its lower end, as shown by the upper drum 2 in the FIGURE. The drum floor 10, as a whole, is bent inwardly only so far however that the height of the convolution of the lid 3 is greater than the projection of the convolution of the floor 10. The floor is bulged inwardly at its center such that the floor bulge 11 has a curvature toward the interior of the drum which is greater than that of the outwardly curved bulge 9 of the lid 3, so as to avoid contact between the floor 10 and lid 3 when the drums are stacked.

The rim 12 of the drum floor 10, which projects radially beyond the drum wall, is initially curved downwardly away from the floor 10 and then upwardly toward the drum 2, forming a rounded annular section in the form of a channel forming an outer roll edge 13 and a bottom edge 14. The rim 12 is provided with openings 15 at the bottom edge 14 so that liquid collected in the channel will be drained. The transitions from the drum wall to the floor rim 12 are made especially smooth and gradual to avoid formation of corners and gaps which could invite the attack of corrosion. To all surfaces of the drums 1, 2 and of the drum lid 3 multiple layers of a high-quality coating are applied.

An approximately circular resilient jacket 16, which, with its outer end extends all around the roll edge 13 and into the inner chamber area thereof, is disposed around the floor rim 12 and covers the roll edge 13 and the floor edge 14. This prevents damage to the outer edge 17 of the bead of the formed resilient jacket 16 during rolling of the drum on the roll edge 13. The inner rim 18 of the formed resilient jacket 16 extends radially toward the center of the floor 10 up to the beginning of the floor bulge 11 and covers the contact region 19 between the vertically stacked drums 1 and 2. The formed resilient jacket 16 consists of rubber and is perforated in the area of the floor edge 14 at the openings 15.

An additional cylindrical insert 20 is disposed within the drums 1, 2. The insert 20 consists of a bottom section 21 abutting the floor bulge 11 of the drum floor 10 and of a cylindrical wall section 22 mounted on the floor section 21. The space or gap 25 between the two is cast in. The insert 20 consists of fiberglass reinforced plastic, wherein the cylindrical wall piece 22 is formed from a normally planar sheet, which, when placed in the drum, abuts, and is supported by, the inside of the drum wall.

LISTING OF REFERENCE NUMERALS

1 Lower storage drum
2 Upper storage drum
3 Drum lid
4 Lid flange
5 Drum flange
6 Bolts
7 Seal
8 Rim
9 Lid bulge
10 Drum floor
11 Floor bulge
12 Floor rim
13 Roll edge
14 Floor edge
15 Drainage opening
16 Seal structure
17 Outer rim
18 Inner rim
19 Contact region
20 Insert
21 Floor section
22 Wall piece
23 Outer edge
24 Protection ring
25 Gap, space

We claim:

1. A stackable long-term storage container for hazardous substances, especially for the storage of radioactive waste, said container comprising a hollow cylindrical body having an inwardly protruding bottom and an outwardly projecting lid with the lid convolution having a height greater than the depth of the floor convolution, and adapted to fit inside the bottom convolution upon stacking, said lid having a radially projecting rim portion for grabbing of the container, said bottom having a rim and said lid having a flange and said container having seal flanges of a diameter greater than the diameter of said cylindrical body which thereby form rolling edges, the bottom rim of said container being bent smoothly axially away from the body and then bent over upwardly toward the drum body with the bent over section having formed therein drain openings, a resilient jacket disposed about said floor rim such that it extends around the bottom edge and covers the roll edge and with its inner end extends inwardly at the bottom toward the center thereof so as to be disposed between the contact area of two vertically stacked drums, said jacket also being perforated at the locations of the drainage openings, said floor having an inwardly curved center portion and said drum lid having an outwardly curved center section with a curvature smaller than that of the center bottom section, said container further having a cylindrical fiberglass reinforced plastic insert with a bottom piece abutting the drum bottom and a wall section abutting the drum wall and the corner area adjacent the bottom piece and the wall section of said insert having a cast in edge.

2. A container according to claim 1, wherein an impact protection ring of L-shaped cross-section surrounds the outer edge of said lid flange with its radially inwardly projecting section being engaged between the lid and drum flanges.

* * * * *